US007913699B2

(12) United States Patent
Strickland et al.

(10) Patent No.: US 7,913,699 B2
(45) Date of Patent: Mar. 29, 2011

(54) TOBACCO ARTICLES AND METHODS

(75) Inventors: James Arthur Strickland, Goodlettsville, TN (US); Frank Scott Atchley, Nashville, TN (US)

(73) Assignee: U.S. Smokeless Tobacco Company LLC, Richmond, VA (US)

( * ) Notice: Subject to any disclaimer, the term of this patent is extended or adjusted under 35 U.S.C. 154(b) by 537 days.

(21) Appl. No.: 11/626,197

(22) Filed: Jan. 23, 2007

(65) Prior Publication Data

US 2007/0186943 A1 Aug. 16, 2007

Related U.S. Application Data

(60) Provisional application No. 60/764,108, filed on Jan. 31, 2006.

(51) Int. Cl.
*A24B 1/04* (2006.01)

(52) U.S. Cl. ..... 131/273; 131/270; 128/202.21

(58) Field of Classification Search ..... 131/352, 131/273, 270; 128/202.21
See application file for complete search history.

(56) References Cited

U.S. PATENT DOCUMENTS

| | | | | |
|---|---|---|---|---|
| 3,696,179 | A | 10/1972 | Jacobs | |
| 3,757,798 | A | 9/1973 | Lambert | |
| 4,083,372 | A | 4/1978 | Boden | |
| 4,270,552 | A | 6/1981 | Jenkins et al. | |
| 4,284,089 | A | 8/1981 | Ray | |
| 4,306,033 | A | 12/1981 | Morita et al. | |
| 4,375,441 | A | 3/1983 | Adams et al. | |
| 4,393,884 | A | 7/1983 | Jacobs | |
| 4,624,269 | A * | 11/1986 | Story et al. | 131/352 |
| 4,765,348 | A | 8/1988 | Honeycutt | |
| 4,800,903 | A | 1/1989 | Ray et al. | |
| 4,805,767 | A | 2/1989 | Newman | |
| 4,813,437 | A | 3/1989 | Ray | |
| 4,917,120 | A | 4/1990 | Hill | |
| 4,972,855 | A * | 11/1990 | Kuriyama et al. | 131/355 |
| 5,092,352 | A * | 3/1992 | Sprinkle et al. | 131/352 |
| 5,101,838 | A * | 4/1992 | Schwartz et al. | 131/273 |
| 5,159,942 | A | 11/1992 | Brinkley et al. | |
| 5,167,242 | A * | 12/1992 | Turner et al. | 131/273 |
| D335,934 | S | 5/1993 | Howard | |
| 5,268,209 | A | 12/1993 | Hunt et al. | |

(Continued)

FOREIGN PATENT DOCUMENTS

WO WO 99/25355 5/1999

(Continued)

OTHER PUBLICATIONS

Brown & Williamson Tobacco Corporation Research & Development Internal Correspondence, dated Oct. 6, 1992, Bates # 575100128 through 575100131.

(Continued)

*Primary Examiner* — Khanh Nguyen
*Assistant Examiner* — John Blades
(74) *Attorney, Agent, or Firm* — Fish & Richardson P.C.

(57) ABSTRACT

Some embodiments of a tobacco article may include tobacco disposed in a porous matrix. The tobacco article may provide tobacco, tobacco constituents, or both tobacco and tobacco constituents to the consumer's mouth in the form of particles, liquid, or vapor so as to provide tobacco satisfaction to the consumer. In some circumstances, the tobacco may be integrally molded with a plastic material so that at least a portion of the tobacco is disposed in pores of the matrix.

15 Claims, 4 Drawing Sheets

U.S. PATENT DOCUMENTS

| | | | | |
|---|---|---|---|---|
| 5,400,808 | A | 3/1995 | Turner et al. | |
| 5,441,060 | A | 8/1995 | Rose et al. | |
| 5,597,589 | A | 1/1997 | Deckard | |
| 5,687,746 | A | 11/1997 | Rose et al. | |
| 5,746,227 | A | 5/1998 | Rose et al. | |
| 5,875,786 | A | 3/1999 | Chase | |
| 5,911,224 | A * | 6/1999 | Berger | 131/332 |
| 5,996,589 | A | 12/1999 | St. Charles | |
| 6,024,012 | A | 2/2000 | Luzenberg, Jr. | |
| 6,098,632 | A | 8/2000 | Turner et al. | |
| 6,102,036 | A | 8/2000 | Slutsky et al. | |
| 6,234,169 | B1 | 5/2001 | Bulbrook et al. | |
| 6,360,477 | B1 | 3/2002 | Flashinski et al. | |
| 6,541,055 | B1 | 4/2003 | Luzenberg | |
| 6,606,998 | B1 | 8/2003 | Gold | |
| 6,617,546 | B2 | 9/2003 | Manetsberger et al. | |
| 6,651,848 | B1 | 11/2003 | Redmond | |
| 6,769,436 | B2 * | 8/2004 | Horian | 131/273 |
| 6,790,496 | B1 * | 9/2004 | Levander et al. | 428/35.7 |
| 6,796,436 | B2 | 9/2004 | Whitehill et al. | |
| 6,797,105 | B1 | 9/2004 | Schumann et al. | |
| 6,984,671 | B2 | 1/2006 | Johnson et al. | |
| 2003/0070687 | A1 | 4/2003 | Atchley et al. | |
| 2003/0094182 | A1 | 5/2003 | Atchley et al. | |
| 2003/0168375 | A1 | 9/2003 | Jarvis et al. | |
| 2004/0118421 | A1 | 6/2004 | Hodin et al. | |
| 2004/0118422 | A1 | 6/2004 | Lundin et al. | |
| 2005/0115580 | A1 | 6/2005 | Quinter et al. | |
| 2005/0178398 | A1 | 8/2005 | Breslin et al. | |
| 2005/0244521 | A1 | 11/2005 | Strickland et al. | |
| 2006/0037623 | A1 | 2/2006 | Lawrence | |
| 2008/0021072 | A1 | 1/2008 | Luzenberg | |
| 2008/0210249 | A1 | 9/2008 | Luzenberg | |

FOREIGN PATENT DOCUMENTS

| | | |
|---|---|---|
| WO | WO 00/10795 | 3/2000 |
| WO | WO 00/44559 | 8/2000 |
| WO | WO 00/64779 | 11/2000 |
| WO | WO 2004/098324 | 11/2004 |
| WO | WO 2008/013733 | 1/2008 |
| WO | WO 2008/059375 | 5/2008 |
| WO | WO 2008/121403 | 10/2008 |

OTHER PUBLICATIONS

Hanners, "ASH on New Secret memo Helping FDA," http://www.no-smoking.org/may99/05-24-99-2.html, dated May 23, 1999 5 pages.

Brown & Williamson Tobacco Corporation Internal Correspondence, dated Dec. 20, 1984, Bates # 509000972 through 509000980, 620396343, 12 pages.

Brown & Williamson Tobacco Corporation Research, Development & Engineering Meeting Report, dated Apr. 24, 1986, Bates # 620396341 through 620396342.

Brown & Williamson Tobacco Corporation Research & Development Internal Correspondence, dated May 15, 1995, Bates # 397100104 through 397100107, 6 pages.

RJ Reynolds Brainstorming Ideas—Scientist Group, dated Jan. 27, 1993, Bates # 51293 4749 through 51293 4753, 5 pages.

American Tobacco, The Vaporette Inhaler System, Loaded to tobaccodocuments.org on Nov. 23, 1998, 7 pages.

Philip Morris Brainstorming Session, dated Aug. 21, 1990, Bates # 2020256092-2020256094.

Hasenfratz et al., Nicotine Absorption and the Subjective and Physiologic Effects of Nicotine Toothpicks, *Clin. Pharmocol. Ther.*, 1991, 50: 456-461, Bates # 2050803545 through 2050803550.

"Innovene Some barriers are meant to be overcome . . . ours aren't" Barex resins, Sep. 2005, Innovene USA LLC, pp. 1-5.

* cited by examiner

TOBACCO ARTICLES AND METHODS

CROSS-REFERENCE TO RELATED APPLICATION

This application claims priority to U.S. provisional application Ser. No. 60/764,108 filed on Jan. 31, 2006 by Strickland et al. and entitled "Tobacco Articles and Methods," the contents of which are incorporated herein by reference.

TECHNICAL FIELD

This document relates to tobacco articles and methods of making such tobacco articles.

BACKGROUND

Smokeless tobacco products are manufactured in a variety of forms including chewing tobacco, dry snuff, and moist snuff. Generally, these types of products are made using one or more of the following steps: cutting or grinding the tobacco into a particular size; dipping or spraying the tobacco with a casing solution; partially drying the tobacco; storing the tobacco in containers for a period of time; and packaging it.

An adult consumer who chooses to use a smokeless tobacco product selects the product according to their individual preferences, such as flavor, cut of tobacco, form, ease of use, and packaging.

SUMMARY

Some embodiments of a tobacco article may include tobacco disposed in a porous matrix. The tobacco article may provide tobacco, tobacco constituents, or both tobacco and tobacco constituents to the adult consumer's mouth in the form of particles, liquid, or vapor so as to provide tobacco satisfaction to the adult consumer. For example, the tobacco article may comprise a substantially cylindrical body having tobacco disposed in the pores of a porous matrix so that the adult consumer may draw air and tobacco vapors through the pores and into the consumer's mouth for receiving tobacco and tobacco constituents or tobacco constituents. In another example, the tobacco article may comprise a conduit body having tobacco disposed in the pores of a porous matrix, and at least a portion of the conduit body may be configured to be wetted (e.g., temporarily exposed to water or another liquid) so that the consumer may draw liquid from the wetted portion, through the porous matrix, and to the consumer for the tobacco or tobacco constituents. In a further example, the tobacco article may comprise a body configured to be wholly received by the consumer, and at least a portion of the body may have tobacco disposed in the pores of a porous matrix so that the consumer's saliva or another liquid may pass through the pores for releasing tobacco or tobacco constituents into the consumer's mouth. In further aspect of this particular embodiment, another portion of the article may also be comprised of said pores of the porous matrix so that the consumer's saliva may be absorbed in a manner to alleviate the need for expectoration. In particular embodiments of a tobacco article, the tobacco may be integrally molded with a plastic material, said material being hydrophobic, hydrophilic or a combination thereof so that at least a portion of the tobacco is disposed in pores of the matrix.

In some embodiments, a tobacco article may comprise a substantially cylindrical body including a porous matrix and an outer shell surface impermeable to migration of tobacco constituents. The outer shell surface may at least partially surround the porous matrix. The article may also comprise tobacco disposed in pores of the porous matrix so that, when air is passed through the porous matrix, at least one of tobacco or a tobacco constituent is introduced into the air flowing through the article by way of vaporization.

In other embodiments, a tobacco article may comprise a conduit body including a porous matrix and an outer shell surface. The outer shell surface may at least partially surround the porous matrix. The article may further include tobacco disposed in pores of the porous matrix so that, when at least a portion of the porous matrix is exposed to a liquid, at least one of tobacco or a tobacco constituent is introduced into the liquid. Wetting of said article may occur through complete submersion thereof, through capillary action, or through injection.

In certain embodiments, a tobacco article may comprise a conduit means for receiving a liquid. The conduit means may include a porous means for retaining tobacco in a network of pores and a shell means for guiding the liquid in the porous means. The shell means may at least partially surround the porous means. The tobacco article may also comprise tobacco disposed in the pores of the porous means so that, when at least a portion of the porous means is exposed to a liquid, at least one of tobacco or a tobacco constituent is introduced into the liquid.

Some embodiments may include a method of introducing tobacco or tobacco constituents into liquid. The method may comprise exposing to liquid in a reservoir a first end portion or second end portion of a tobacco article. The tobacco article may include a conduit body including a porous matrix and an outer shell surface. The outer shell surface may at least partially surround the porous matrix, and tobacco may be disposed in pores of the porous matrix. The method may further comprise introducing at least one of tobacco or a tobacco constituent into the liquid by drawing the liquid through the pores of the porous matrix and over the tobacco disposed in the pores.

In further embodiments, a tobacco article may comprise a body that is wholly receivable in a mouth of a consumer, and the body may include a porous polymer matrix. The article may also comprise tobacco disposed in pores of the porous polymer matrix so that, when the body is exposed to saliva, at least one of tobacco or a tobacco constituent is introduced into the saliva. In further aspect of this particular embodiment, another portion of the article may include a second porous matrix so that the consumer's saliva may be absorbed in a manner to alleviate the need for expectoration.

Some of these embodiments may provide one or more of the following advantages. First, the tobacco article may provide tobacco satisfaction in the form of the experience associated with tobacco organoleptic components and added flavor components that are released in the mouth. Such organoleptic components may relate or contribute to the integrated sensory perception by the adult consumer that includes, for example, any combination of aroma, fragrance, flavor, taste, odor, mouth feel, or the like. Second, the tobacco article may provide tobacco constituents (e.g., flavors, aromas, alkaloids, or the like) to the consumer without combusting any part of the tobacco article. Third, one or more flavor agents may be added to the tobacco article to further enhance the consumer's experience. Fourth, some embodiments of the tobacco article may be manufactured in a repeatable and efficient manner. For example, in some circumstances, the tobacco may be integrally molded with the plastic granules so as to form an impermeable outer shell of polymer material that at least partially surrounds a porous interior matrix that retains the tobacco. Fifth, the tobacco article may be formed of a shape and appearance that resembles traditionally recognized shapes, such as a cigarette, a cigar, or a pouch of chewing tobacco.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
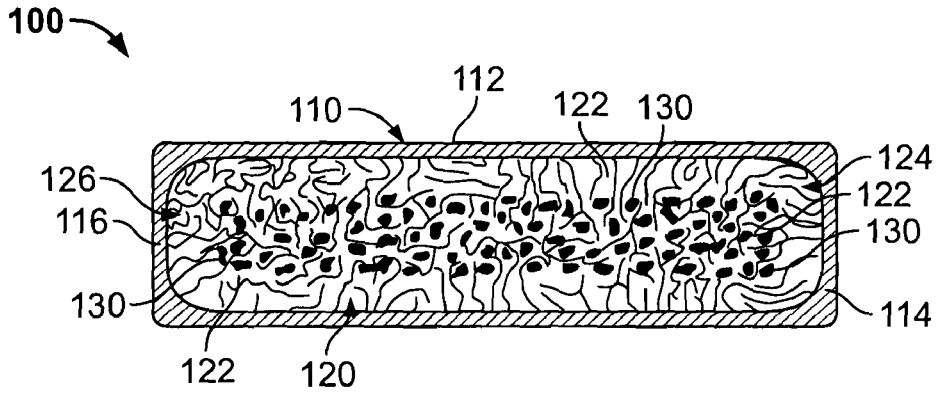
FIG. 1 is a cross-sectional view of a tobacco article in accordance with some embodiments.

Referring to FIG. 1, a tobacco article 100 may include an outer shell surface 110 that at least partially surrounds a porous matrix 120. Tobacco 130 may be disposed in pores 122 of the porous matrix 120 so that the tobacco article 100 may provide tobacco, tobacco constituents, or both tobacco and tobacco constituents to a consumer's mouth in the form of particles, liquid, or vapor. As described in more detail below, providing of tobacco or tobacco constituents may provide tobacco satisfaction to the consumer.

The tobacco article 100 may be a noncombustible product in so far as the article 100 preferably does not require ignition during usage. In these embodiments, the tobacco article 100 may provide tobacco, tobacco constituents (e.g., flavors, aromas, alkaloids, or the like), or both tobacco and tobacco constituents to the consumer without combusting any part of the tobacco article 100 (and without igniting the tobacco 130 inside the article 100). Instead, the noncombusted tobacco and/or noncombusted tobacco constituents may be provided to the consumer to provide tobacco satisfaction in the form of the experience associated with tobacco constituents, organoleptic components and added flavor components that are released upon usage. Such organoleptic components may relate or contribute to the integrated sensory perception by the consumer that includes, for example, any combination of aroma, fragrance, flavor, taste, odor, mouth feel, or the like.

The tobacco article 100 may have a substantially cylindrical outer shape and may be configured to rest between the fingers of a consumer. At least a portion of the tobacco article 100 may comprise a moldable polymer to permit that portion to be molded into the desired shape. In some embodiments, the outer shell surface 110 and the porous matrix 120 may be integrally formed. Also, in some embodiments, the tobacco 130 and the porous matrix 120 may be integrally molded so that the tobacco 130 is disposed in the pores 122 when the porous matrix is formed. In addition or in the alternative, the tobacco article 100 may have the tobacco 130 added through addition of a tobacco slurry containing constituents, organoleptic components and added flavor components added therein after forming by way of injection, absorption or any other like method. The outer shell surface 110 and the porous matrix 120 may include the same moldable plastic material or different moldable plastic materials provided that the outer shell surface 110 is impermeable to the tobacco 130.

Still referring to FIG. 1, the outer shell surface 110 may fully or partially surround the porous matrix 120 and the tobacco 130 disposed therein. In this embodiment, the outer shell surface 110 is formed to fully surround the porous matrix 120 within a longitudinally extending surface 112 and first and second cap surfaces 114 and 116. The outer shell surface 110 may comprise a generally continuous layer of material that is impermeable to the migration of tobacco constituents inside the article 100. Alternatively, the article 100 may be constructed in such a way that the first and second cap surfaces 114 and 116 are not created during formation. Either configuration may inhibit the tobacco 130 or tobacco constituents (e.g., flavors, aromas, alkaloids, or the like) from migrating away from the porous matrix 120 before the ordinary use of the article 100 has commenced. In some embodiments, the outer shell surface 110 may comprise a polymer material that can be formed to provide the substantially continuous layer. Formation of the article 100 or any parts thereof excluding the tobacco particles 130, may be made using any material suitable therefore or combination thereof. For example, the article 100 may comprise a copolymer of acrylonitrile and methyl acrylate (or an equivalent resin) known to provide barrier characteristics that inhibit the migration of the tobacco constituents, including volatile tobacco constituents. Such a copolymer of acrylonitrile and methyl acrylate is available under the trade name BAREX™ from Innovene LLC of Chicago, Ill. Some other polymer materials, such as polyethylene naphthalate (PEN), polytrimethylene naphthalate (PTN), or some polyester-based liquid crystal polymers (LCP), may alternatively be employed to provide barrier characteristics that inhibit the migration of the tobacco constituents. Furthermore, glass wool, cellulose fibers, a tobacco matrix such as reconstituted sheet or tobacco leaf, shreds and the like or any other type inert material may be used to form the porous matrix 120.

The porous matrix 120 may comprise a plurality of pores 122 that are arranged to permit the passage of air from a first portion 124 to a second portion 126. In some embodiments, the pores 122 may be randomly oriented to form a network of miniature passages through which air may pass over the tobacco 130 disposed in the porous matrix 120. In other embodiments, the pores 122 may be manufactured to have a generally predetermined pore orientation, such as a plurality of pores that extend in a generally axial direction within the porous matrix 120. The porous matrix 120 may be formed in a manner to control the average pore size, pore volume, or both. For example, as described in more detail below, the porous matrix 120 may be formed using a plastic sintering process in which granules of a polymer material are subjected to a controlled heating process for a regulated period of time. Furthermore, the article 100 may be colored or wrapped in paper or reconstituted tobacco sheet after formation thereof as desired.

It should be understood that, in some embodiments, the tobacco article 100 may comprise one or more polymer materials other than the previously described BAREX™ material. For example, the porous matrix 120 or other portions of the article 100 may include one or more of the following polymer materials: acetals, acrylics such as polymethylmethacrylate and polyacrylonitrile, alkyds, polymer alloys, allyls such as diallyl phthalate and diallyl isophthalate, amines such as urea, formaldehyde, and melamine formaldehyde, cellulosics such as cellulose acetate, cellulaose triacetate, cellulose nitrate, ethyl cellulose, cellulose acetate propionate, cellulose acetate butyrate, hydroxypropyl cellulose, cellophane and rayon, chlorinated polyether, coumarone-indene, epoxy, fluorocarbons such as PTFE, FEP, PFA, PCTFE, ECTFE, ETFE, PVDF, and PVF, furan, hydrocarbon resins, nitrile resins, polyaryl ether, polyaryl sulfone, phenol-aralkyl, phenolic, polyamide (nylon), poly (amide-imide), polyaryl ether, polycarbonate, polyesters such as aromatic polyesters, thermoplastic polyester, PBT, PTMT, PET and unsaturated polyesters such as SMC and BMC, polyimides such as thermoplastic polyimide and thermoset polyimide, polymethyl pentene, polyolefins such as LDPE, LLDPE, HDPE, and UHMWPE, polypropylene, inomers such as PD and poly allomers, polyphenylene oxide, polyphenylene sulfide, polyurethanes, poly p-xylylene, silicones such as silicone fluids and elastomers, rigid silicones, styrenes such as PS, ADS, SAN, styrene butadiene latricies, and styrene based polymers, suflones such as polysulfone, polyether sulfone and polyphenyl sulfones, thermoplastic elastomers, and vinyls such as PVC, polyvinyl acetate, polyvinylidene chloride, polyvinyl alcohol, polyvinyl butyrate, polyvinyl formal, propylene-vinyl chloride copolymer, ethylvinyl acetate, and polyvinyl carbazole.

Still referring to FIG. 1, the tobacco 130 may be whole, shredded, cut, cured, aged, fermented, granulated or powdered, encapsulated, or otherwise processed. For example, as shown in FIG. 1, the tobacco 130 may be in a granulated or powdered form so that the tobacco 130 is sized to fit within the pores 122 of the porous matrix 120. Further, it should be understood that the tobacco 130 may include an extract of tobacco that provides tobacco constituents (e.g., flavors, aromas, alkaloids, or the like), as described in more detail below. In some circumstances, some or all of the tobacco 130 in the article 100 may be processed from reconstituted tobacco.

In some embodiments, the tobacco 130 may include portions of leaves, flowers, roots, stems, or extracts thereof of any member of the genus *Nicotiana*. Exemplary species include *N. rustica* and *N. tabacum* (e.g., varieties and/or cultivars designated LA B21, LN KY171, TI 1406, Basma, Galpao, Perique, Beinhart 1000-1, and Petico). Other species include *N. acaulis, N. acuminata, N. acuminata* var. *multiflora, N. africana, N. alata, N. amplexicaulis, N. arentsii, N. attenuata, N. benavidesii, N. benthamiana, N. bigelovii, N. bonariensis, N. cavicola, N. clevelandii, N. cordifolia, N. corymbosa, N. debneyi, N. excelsior, N. forgetiana, N. fragrans, N. glauca, N. glutinosa, N. goodspeedii, N. gossei, N. hybrid, N. ingulba, N. kawakamii, N. knightiana, N. langsdorffii, N. linearis, N. longiflora, N. maritima, N. megalosiphon, N. miersii, N. noctiflora, N. nudicaulis, N. obtusifolia, N. occidentalis, N. occidentalis* subsp. *hesperis, N. otophora, N. paniculata, N. pauciflora, N. petunioides, N. plumbaginifolia, N. quadrivalvis, N. raimondii, N. repanda, N. rosulata, N. rosulata* subsp. *ingulba, N. rotundifolia, N. setchellii, N. simulans, N. solanifolia, N. spegazzinii, N. stocktonii, N. suaveolens, N. sylvestris, N. thyrsiflora, N. tomentosa, N. tomentosiformis, N. trigonophylla, N. umbratica, N. undulata, N. velutina, N. wigandioides*, and *N. x sanderae*.

In some embodiments described herein, the tobacco 130 may include one or more components such as flavor extracts, flavor masking agents, bitterness receptor site blockers, receptor site enhancers, sweeteners, and additives such as chlorophyll, minerals, botanicals, or breath freshening agents. Some of these components are described, for example, in U.S. patent application Ser. Nos. 10/982,248 and 10/979,266, both of which are incorporated herein by reference. Such components may be present in the tobacco 130 as a powder, an oil, a powder in fine particulate form, or in encapsulated form.

In some embodiments, the tobacco 130 may be processed to include these flavor components prior to construction of the article 100. For example, some components can be added by spraying a flavor extract. In another example, flavor can be imparted to tobacco 130 by combining solid or liquid flavor agents with a tobacco material and incubating under suitable conditions, as described, for example, in previously incorporated application Ser. No. 10/982,248. In addition, the tobacco 130 may be processed to include these flavor components after construction of the article 100 via capillary action, injection, or other introduction means.

Suitable flavors and flavor extracts include menthol, cinnamon, wintergreen, cherry, berry, peach, apple, spearmint, peppermint, bergamot, vanilla, coffee, a mint oil from species of the genus *Mentha* or other desired flavors. Flavors may also be provided by plant matter, e.g., mint leaves, which are typically 10% flavor oils and 90% insoluble fiber. Suitable plant matter may be obtained from plants such as clove, cinnamon, herb, cherry, peach, apple, lavender, rose, vanilla, lemon, orange, coffee, or species of the genus *Mentha*. Flavor may be provided by synthesized flavors, flavor extracts, plant matter, or a combination thereof. As further provided herein, flavor may also be provided by imitation, synthetic, or artificial flavor ingredients and blends containing such ingredients. Suitable sweeteners include sucralose, acesulfame potassium (Ace-K), aspartame, saccharine, cyclamates, lactose, sucrose, glucose, fructose, sorbitol, and mannitol.

Figure 2:
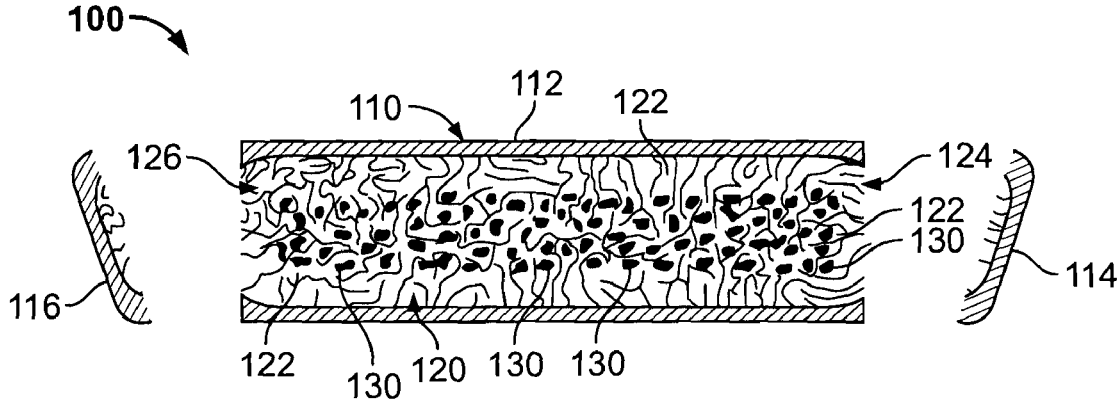
FIG. 2 is a cross-sectional view of the tobacco article of FIG. 1.

Referring now to FIG. 2, some embodiments of the tobacco article 100 may be configured to expose the first and second portions 124 and 126 of the porous matrix 120. For example, in the embodiments in which the outer shell surface 110 includes first and second cap surfaces 114 and 116, at least a portion of each cap surface 114 or 116 may be cut, punctured, or otherwise removed to expose the first and second ends 124 and 126 of the porous matrix 120. This removal process may be performed during the manufacturing or packaging of the tobacco article 100 (e.g., cutting the cap surfaces 114 and 116 to provide a uniform length of the article and then wrapping one or more articles 100 in an impermeable package) or may be performed by the consumer immediately before using the tobacco article 100. In some embodiments, the tobacco article 100 may be supplied to the consumer in a package that includes a cutter mechanism or a puncture mechanism to facilitate the use of the tobacco article. When the cap surfaces 114 and 16 are removed, the longitudinally extending surface 112 of the outer shell surface 110 may remain intact so as to substantially surround the outer radial area of the porous matrix 120. The first and second portions 124 and 126 of the porous matrix 120 may be exposed to the atmosphere so that air may be passed through the network of pores 122 and over the tobacco 130 disposed therein. As further provided herein, some embodiments of the tobacco article 100 may be configured to expose the first and second portions 124 and 126 of the porous matrix 120 during manufacturing thus eliminating the need to cut the cap surfaces 114 and 116.

Figure 3:
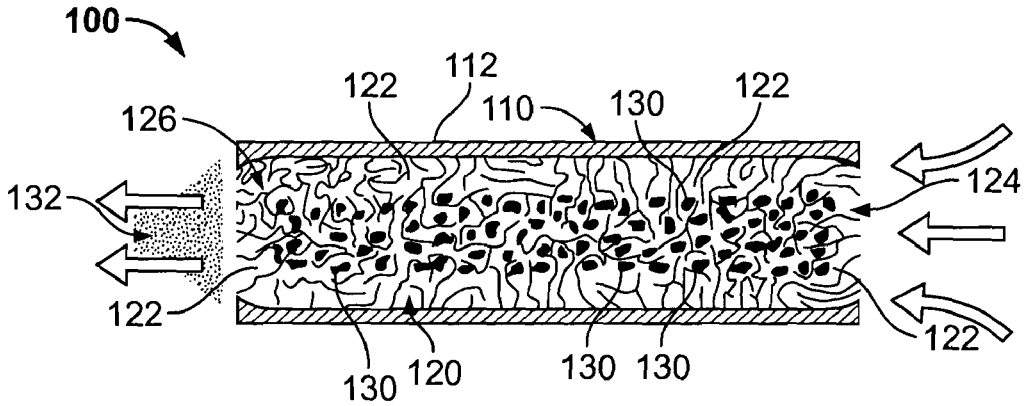
FIG. 3 is a cross-sectional view of a tobacco article in accordance with some embodiments.

Referring to FIG. 3, some embodiments of the tobacco article 100 may be adapted to provide tobacco or tobacco constituents to a consumer in the form of a liquid, vapor or, in particular circumstances, a combination of vapor and fine particles or a combination of vapor and fine particles. In this embodiment, the first and second portions 124 and 126 of the porous matrix 120 may be exposed to the atmosphere, and a consumer may force air from the first portion 124, through the network of pores 122 and over the tobacco 130 disposed therein, and out from the second portion 126. For example, the consumer may create a negative pressure on the tobacco article 100 proximal to the second portion 126 so that the air is drawn through the porous matrix 120 and into the consumer. As the air passes through the porous matrix 120, tobacco constituents 132 may be introduced into the air and are provided to the consumer. The tobacco constituents (e.g., flavors, aromas, alkaloids, or the like) may be in the form of vapor that transfers from the tobacco 130 to the air that is passed through the porous matrix 120. As previously described, the tobacco 130 may be supplemented with extract of tobacco that provides additional tobacco constituents to the tobacco 130 in the porous matrix 120, thereby further increasing the level of tobacco constituents 132 that may be experienced by the consumer. Accordingly, the tobacco article 100 may provide tobacco satisfaction in the form of the experience associated with tobacco organoleptic components and added flavor components that are released upon usage. Such organoleptic components may relate or contribute to the integrated sensory perception by the consumer that includes, for example, any combination of aroma, fragrance, flavor, taste, odor, mouth feel, or the like. Further, the tobacco article 100 may provide the tobacco constituents 132 to the consumer without combusting the tobacco article 100 or the tobacco 130 disposed therein. As previously described, tobacco 130 may include one or more flavor agents, or flavor agent particles may be disposed in the pores 122 of the porous matrix 120. In these circumstances, the flavor agents may be introduced into the air so that a combination of flavor agents and tobacco constituents 132 are provided to the consumer.

In particular embodiments, the tobacco 130 may be arranged in a manner that permits the tobacco article 100 to provide tobacco and tobacco constituents to a consumer in the form of vapor and fine particles. For example, the tobacco 130 in the porous matrix 120 may be finely granulated so that fine tobacco particles are capable of passing through the network of pores 122 in the porous matrix 120. In such circumstances, the consumer may suck on the tobacco article 100 proximal to the second portion 126 so that the air is drawn through the porous matrix 120 by the consumer. As the air passes through the porous matrix 120, the fine tobacco particles and tobacco constituents 132 may be provided to the consumer as a combination of vapor and fine particles. Again, the tobacco article 100 may provide tobacco satisfaction to the consumer without combusting the tobacco article 100 or the tobacco 130 disposed therein.

Figure 4A:
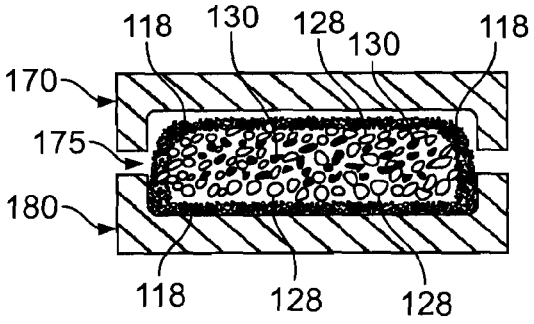
FIGS. 4A-B are cross-sectional views of a process for manufacturing a tobacco article in accordance with some embodiments.
Figure 4B:
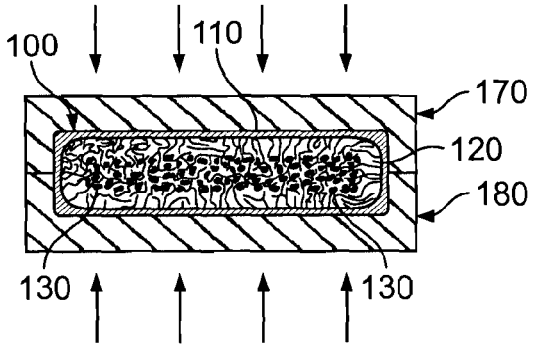

FIGS. 4A-B describe an example of a plastic sintering process to form the porous matrix 120 or the entire article 100. Such a plastic sintering process may include controlled application of heat using one of a variety of heating techniques, some of which are described, for example, in U.S. Pat. No. 4,375,441 to Adams et al. (which is incorporated herein by reference). It should be understood that plastic sintering is only one process of several possible processes that may be used to form the porous matrix of the tobacco articles described herein.

Referring now to FIGS. 4A-B, some embodiments of the tobacco article 100 may be integrally formed in a molding process. In this embodiment, the outer shell surface 110 and the porous matrix 120 may be integrally formed using a plastic sintering process. In some circumstances, the tobacco 130 may be mixed with the polymer granules 128 during the molding process so that the tobacco 130 is integrally molded with the porous matrix 120. It should be understood that, in other embodiments, the tobacco 130 may be integrally molded with the porous matrix 120 without necessarily forming the outer shell surface 110. Also, it should be understood that the tobacco 130 can be pressure injected into the porous matrix 120 after the formation of the porous matrix 120 (e.g., the tobacco 130 may not be integrally molded with the porous matrix 120).

As shown in FIG. 4A, the formation process may include first and second mold pieces 170 and 180 that may fit together to define and internal cavity 175. The internal cavity may include machined surfaces that at least partially define the desired outer shape of the tobacco article 100. The tobacco 130 and the polymer resins that are combined to form the tobacco article 100 may be placed in the internal cavity 175. As previously described, the outer shell surface 110 may be formed to have a generally continuous layer of material that is impermeable to the migration of tobacco constituents, such as BAREX material. Accordingly, granules 118 of this copolymer may be arranged along the outer portions of the internal cavity 175 so that these granules 118 can be merged to form at least a portion of the outer shell surface 110 during the plastic sintering process. The granules 128 of polymer material that form at least a portion of the porous matrix 120 may be arranged in a central portion of the internal cavity 175. As described in more detail below, these granules 128 may comprise a different polymer material and may have a larger average size that the outer granules 118 so as to provide a network of pores 122 after the molding process. Further, the tobacco 130 may be mixed with the central granules 128 before or during insertion into the cavity 175. Accordingly, the tobacco 130 may be intermixed with the granules 128 during the plastic sintering process so that at least a portion of the tobacco 130 is disposed in the pores 122 after the granules 128 have formed the porous matrix 120. (It should be understood that the granules 118 and 128 and the tobacco 130 are not necessarily drawn to scale, and the sizes may be exaggerated for purposes of illustration.)

Referring to FIG. 4B, when the granules 118 and 128 and the tobacco 130 are arranged in the mold cavity 175, the mold pieces 170 and 180 may apply pressure while the granules 118 and 128 are heated in for a controlled period of time. Such pressure and heat causes the outer shell surface 110 to form into its desired shape while the central granules 128 are controllably melted for a limited period of time. While it is not intended that the present invention be limited by any theory by which it achieves its advantageous result, it is believed that, during this plastic sintering process, the outer granules 118 may melt at a faster rate to form a substantially continuous layer along the outer shells surface 110, while the central granules 128 melt at a slower rate (e.g., the granule surfaces may partially heat to bond with adjacent granules even though some of the granules 128 may not completely melt). Such a process may form a porous matrix 120 that is at least partially surrounded by the outer shell surface 110. It should be understood that some portion of the central granules 128 may melt and merge with outer granules along a transition zone near the outer shell surface 110. In some circumstances, the central granules 128 may comprise a different polymer material, may have a larger average size, or both compared to the outer granules 118 so as facilitate the slower melting rate of the granules 128 along the interior of the tobacco article 100. Because the tobacco 130 was mixed with the central granules 128, at least a portion of the tobacco 130 may be disposed in the pores 122 after the granules 128 have formed the porous matrix 120. It should be understood that some characteristics of the pores 122 (e.g., average pore size, average pore volume, or the like) may be selected by varying, for example, the size of granule materials used to form the porous matrix 120, the temperature level at which the granules 128 are heated, the amount of time at which the granules 128 are heated, and the pressure used in a molding process.

In this embodiment, the central granules 128 comprise the same copolymer material (e.g., BAREX™) as the outer granules 118, and the central granules may have a larger average size than the outer granules. It should be understood that, in some circumstances, the central granules 128 and the outer granules 118 may have similar average sizes. In some embodiments, the central granules 128 may comprise a material other than the outer granules 118 so that the porous matrix 120 generally comprises a different material that the outer shell surface 110. For example, the central granules may comprise a plastic polymer material, such as polyethylene or polypropylene. Further, the porous matrix 120 may generally comprise a polymer material that is water soluble or water insoluble. It should be understood that a variety of material specifications (e.g., granule size and molecular weight, granule size distribution, material type, tobacco particle size, tobacco particle distribution, and the ratio of polymer granules to tobacco particle) and also a variety of process parameters (e.g., temperature, heat exposure time, and pressure) may be used in accordance with the invention to provide a porous matrix 120 having advantageous characteristics.

Figure 5A:
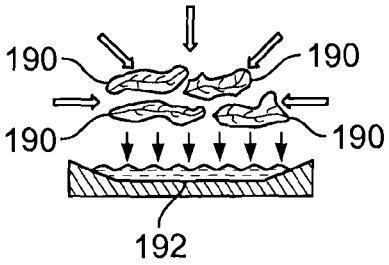
FIGS. 5A-B are side views of a process for preparing tobacco for use in a tobacco article.
Figure 5B:
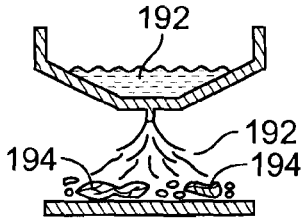
Figure 6:
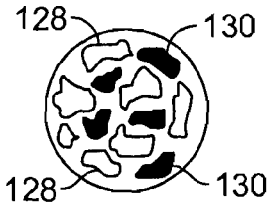
FIG. 6 is a magnified view of polymer granules mixed with the tobacco of FIG. 5B.

Referring now to FIGS. 5A-B, the tobacco 130 that is disposed in the tobacco article 100 may include extracts of tobacco that provide additional tobacco constituents (e.g., flavors, aromas, alkaloids, or the like). As previously described, these additional tobacco constituents may increase the amount of tobacco constituents that are experienced by the consumer during ordinary use of the tobacco article 100. As shown in FIG. 5A, a plurality of tobacco leaves 190 (or flowers or roots or stems) may be subjected to an extraction process that provides a solid or liquid extract 192 having tobacco constituents therein. For example, an aqueous extraction process may be used. As shown in FIG. 5B, the tobacco liquid extract 192 may be applied to tobacco 194 that is whole, shredded, cut, cured, aged, granulated or powdered, or otherwise processed. In some embodiments, a portion of the extracted tobacco 190 (FIG. 5A) may be discarded and the tobacco liquid extract 192 may be applied a lesser amount of the tobacco 194 (FIG. 5B). As such, the tobacco 194 (FIG. 5B) may include tobacco constituents in an amount equal to or greater than that which was originally extracted. These additional tobacco constituents may increase the amount of constituents that are experienced by the consumer during ordinary use of the tobacco article 100. While it is not intended that the present invention be limited by any theory by which it achieves its result, it is believed that, a substantial portion of the tobacco extract 192 may remain on the outer surface of the tobacco 194, thereby facilitating the transfer of the tobacco constituents from the tobacco in the article 100 to the air or liquid that is passed through the porous matrix 120. Tobacco constituents can include carotenoids such as beta-damascenone and megastigmatrienones, alkaloids such as nicotine, and terpenoids such as limonene. The tobacco that includes the tobacco extract 192 may be granulated or powdered to facilitate the placement of the tobacco within the porous matrix 120. As shown in FIG. 6, the granulated or powdered tobacco 130 may be mixed with granules 128 of polymer material at a selected ratio, and the mixture may then be used in an integral molding process (as described, for example, in connection with FIGS. 4A-B).

Figure 7:
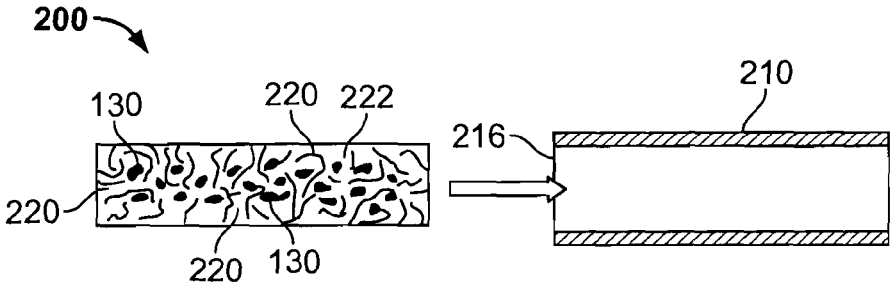
FIG. 7 is a cross-sectional view of a tobacco article in accordance with some embodiments.

Referring now to FIG. 7, some embodiments of a tobacco article 200 may include porous matrix 220 that is formed separately from an outer shell 210. The porous matrix 220 may be formed using a plastic sintering process (as described in connection with FIGS. 4A-B). Alternatively, the porous matrix 220 may be formed using a different process in which the porous matrix 220 comprises a porous glass or ceramic material having tobacco disposed in the pores 222 or in which the porous matrix 220 comprises a fibrous material having a network of pores to receive the tobacco 130 therein. Depending on the formation process of the porous matrix 220, the tobacco 130 may be integrally molded with the porous matrix 220 or may be pressure injected into the porous matrix 220 so that the tobacco 130 is disposed in the pores 222. The porous matrix 220 may be formed or otherwise configured to mate with a separate shell 210. In this embodiment, the separate shell 210 comprises a tubular configuration having an open end 216 to receive the porous matrix 220. As such, the porous matrix 220 may be slid into and engage the separate shell 210.

As previously described, the outer shell 210 may comprise a continuous layer of material that is impermeable to migration of the tobacco and tobacco constituents, such as BAREX™ material. In those embodiments in which the porous matrix 220 should be sealed until being used by a consumer, the separate shell 210 may comprise a tube of BAREX™ that is sealed at the open ends thereof after the porous matrix 220 is inserted into the shell 210. For example, the open ends of the tubular shell 210 may be heat sealed using BAREX™ cap walls. In another example, the open ends of the tubular shell 210 may be heat sealed using a heat pinching process.

Figure 8:
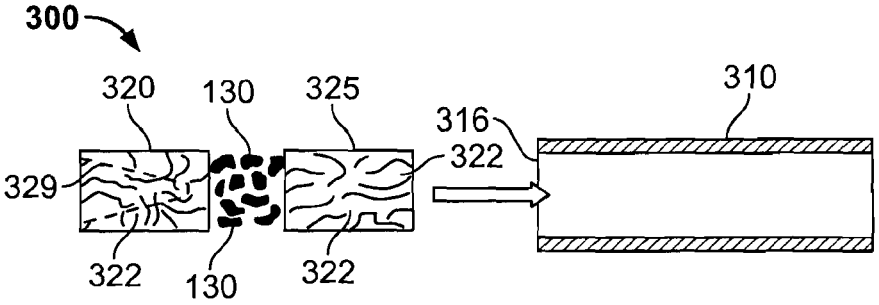
FIG. 8 is a cross-sectional view of a tobacco article in accordance with some embodiments.

Referring to FIG. 8, some embodiments of a tobacco article 300 may include a porous matrix 320 that is formed separately from an outer shell 310 and from the tobacco 130. For example, a first porous matrix 320 and a second porous matrix 325 may be form using a plastic sintering process (as described in connection with FIGS. 4A-B) or using an alternative forming process. The tobacco 130 may be whole, shredded, cut, cured, aged, granulated or powdered, or otherwise processed, and may be disposed in the outer shell 310 between the first porous matrix 320 and the second porous matrix 325. The first porous matrix 320 and the second porous matrix 325 may comprise networks of pores 322 through which air and tobacco constituents may pass, yet the pores may be sized to permit the passage of only fine tobacco particles. The first porous matrix 320 and the second porous matrix 325 may be formed or otherwise configured to mate with the separate shell 310. In this embodiment, the separate shell 310 comprises a tubular configuration having an open end 316 to receive the first porous matrix 320, the tobacco 130, and the second porous matrix 325. As previously described, the separate shell 310 may comprise a tube of BAREX™ that is sealed at the open ends thereof after the first porous matrix 320, the tobacco 130, and the second porous matrix 330 are inserted into the shell 310. For example, the open ends of the tubular shell 310 may be heat sealed using BAREX™ cap walls. In another example, the open ends of the tubular shell 310 may be heat sealed using a heat pinching process.

Optionally, at least one of the first porous matrix 320 and the second porous matrix 330 may include a frusto-conical channel formed therein to provide a jet stream of air toward the tobacco 130 disposed in the tobacco article 300. In such embodiments, air may be forced into the opening of the frusto-conical channel by the consumer drawing air from the opposite end of the tobacco article 300. The flow of air through the channel 329 may increase the air velocity that passes over the tobacco 130, thereby facilitating the transfer of tobacco particles, tobacco constituents, or both tobacco particles and tobacco constituents from the tobacco 130 to the air. It should be understood that such a frusto-conical channel may be formed in the porous matrix of other tobacco articles, such as those described in connection with FIGS. 1-3 and 7.

Figure 9:
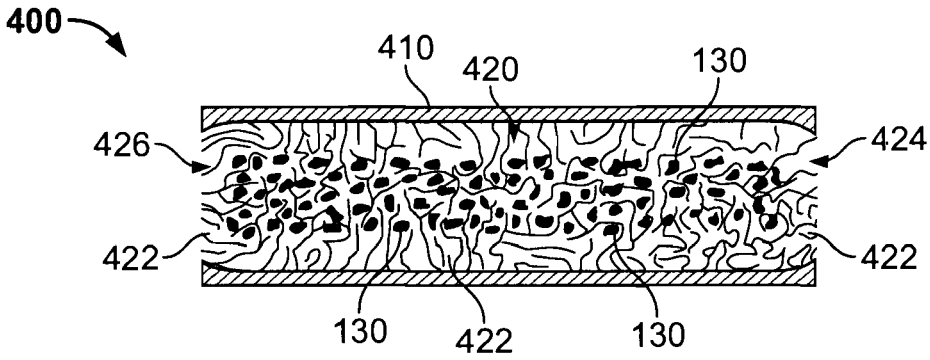
FIG. 9 is a cross-sectional view of a tobacco article in accordance with some embodiments.
Figure 10:
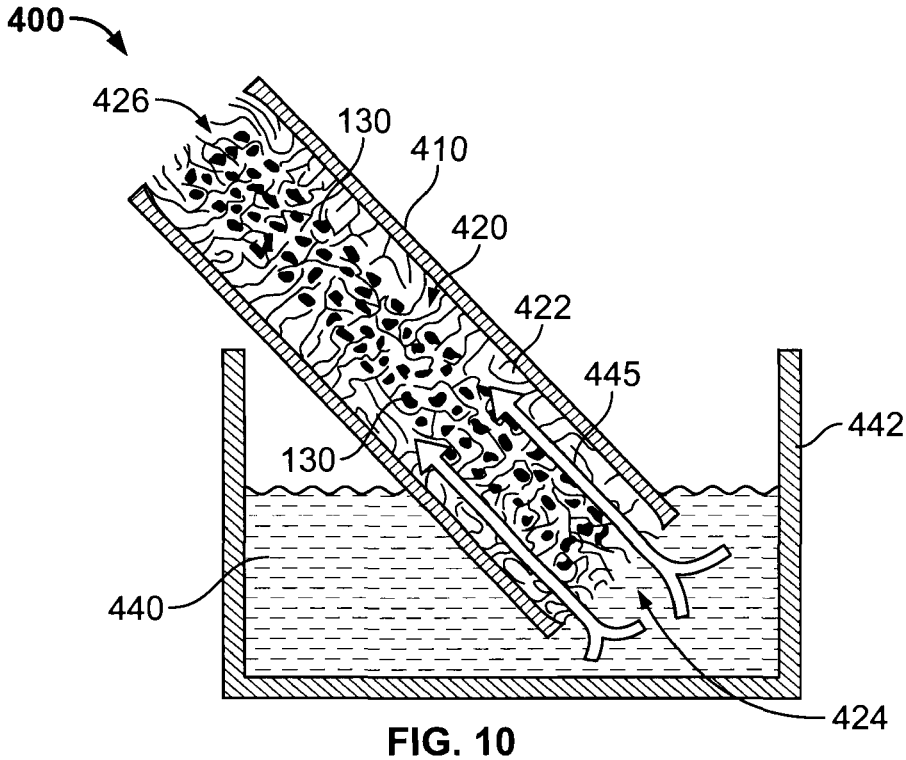
FIG. 10 is a cross-sectional view of the tobacco article of FIG. 9.
Figure 11:
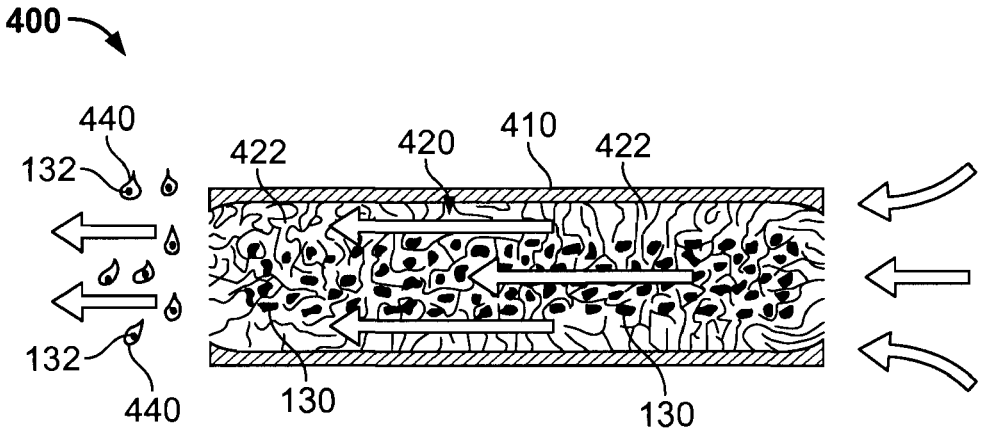
FIG. 11 is a cross-sectional view of the tobacco article of FIG. 10 in accordance with some embodiments.

Referring now to FIGS. 9-11, some embodiments of a tobacco article 400 may be adapted to provide tobacco and/or tobacco constituents to a consumer in the form of a liquid. Such embodiments of the tobacco article 400 may include tobacco 130 disposed in a porous matrix 420, as described, for example, in connection with FIGS. 1-7. The porous matrix 420 may be form using a plastic sintering process (as described in connection with FIGS. 4A-B). Alternatively, the porous matrix 420 may be formed using a different process in which the porous matrix 420 comprises a porous glass or ceramic material having tobacco disposed in the pores 422 or in which the porous matrix 420 comprises a fibrous material having a network of pores to receive the tobacco 130 therein. Depending on the formation process of the porous matrix 420, the tobacco 130 may be integrally molded with the porous matrix 420 or may be pressure injected into the porous matrix 420 so that the tobacco 130 is disposed in the pores 422. Also, the tobacco article 400 may include a conduit 410 that surrounds at least a portion of the porous matrix 420. The conduit 410 may be integrally formed with the porous matrix 420 (as described, for example, in connection with FIGS. 4A-B), or the conduit 410 may be formed separately from the porous matrix 420 (as described, for example, in connection with FIGS. 7 and 8). In this embodiment, the conduit 410 is illustrated having a cylindrical shape, but the conduit 410 may have a different shape. The conduit 410 may comprise a material that prevents the migration of liquid from the outer radial area of the porous matrix 420. As such, any liquid disposed in the porous matrix 420 is forced to pass through an exposed portion 424 or 426 of the porous matrix 420.

As shown in FIG. 10, at least a portion of the porous matrix 420 may be temporarily exposed to a liquid 440 so that the liquid 440 is introduced into the pores 422. For example, the liquid 440 may progress into the pores 422 of the porous matrix 420 through capillary action 445 so that some portion of the liquid remains in the porous matrix 420 even after the tobacco article 400 is removed from the liquid container 442. In some embodiments, the liquid 440 can include water.

As shown in FIG. 11, the first and second portions 424 and 426 of the porous matrix 420 may be exposed to the atmosphere, and a consumer may force air from the first portion 424 and into the network of pores 422. The consumer's vacuum action may cause the liquid 440 that was previously introduced into the first portion 424 of the porous matrix 420 to pass over the tobacco 130 disposed in the pores. As such, the liquid 440 is drawn through the porous matrix 420 and to the consumer. As the liquid 440 passes through the porous matrix 420, tobacco and/or tobacco constituents 132 may be introduced into the liquid 440 so that the tobacco and/or tobacco constituents are experienced by the consumer. The tobacco and/or tobacco constituents 132 may be mixed with the liquid 440.

As previously described, the tobacco 130 may include extract of tobacco that provides additional tobacco constituents to the tobacco 130 in the porous matrix 420, thereby further increasing the level of tobacco constituents 132 that may be introduced in the liquid 440 for providing to the consumer. Accordingly, the tobacco article 400 may provide tobacco satisfaction to the consumer without combusting the tobacco article 400 or the tobacco 130 disposed therein. Optionally, the tobacco 130 may include one or more flavor agents or other components (as previously described), or flavor agent particles may be disposed in the pores 422 of the porous matrix 420. In such circumstances, the flavor agents may be introduced into the liquid 440 so that a combination of flavor agents, tobacco and tobacco constituents 132 are experienced by the consumer.

Figure 12:
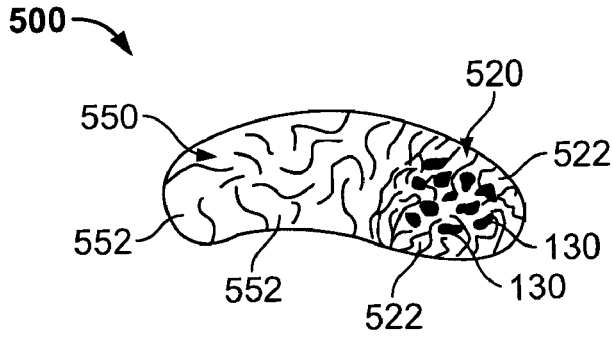
FIG. 12 is a cross-sectional view of a tobacco article in accordance with some embodiments.
Figure 13:
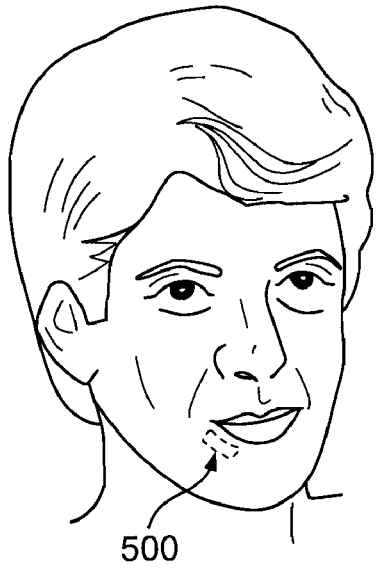
FIG. 13 is a perspective view of the tobacco article of FIG. 12 received in a consumer's mouth.
Figure 14:
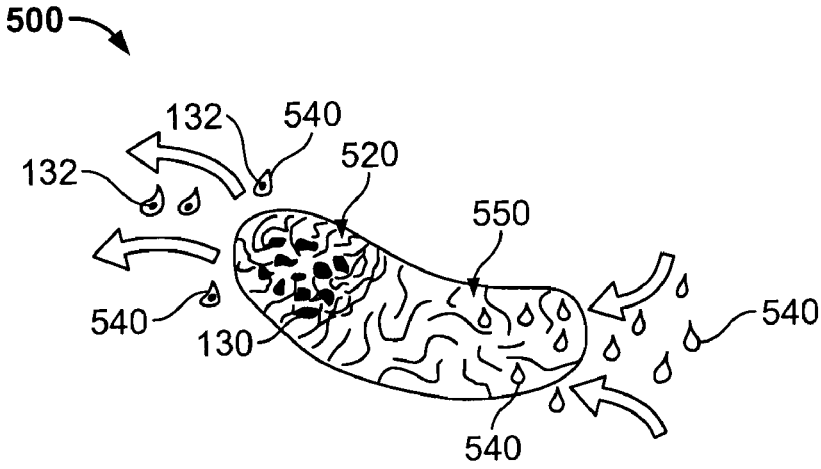
FIG. 14 is a cross-sectional view of the tobacco article of FIG. 13 in accordance with some embodiments.

Referring now to FIGS. 12-14, some embodiments of a tobacco article 500 may be adapted to be wholly received by the consumer and to introduce tobacco and/or tobacco constituents into the consumer's saliva. The tobacco article 500 may be configured to resemble a tobacco pouch. In this embodiments, the tobacco article has generally elliptical shape, but other embodiments may have a pillow shape, a circular shape, a flat rectangular shape, or the like. Such embodiments of the tobacco article 500 may include tobacco 130 disposed in a first porous matrix 520, as described, for example, in connection with FIGS. 1-7. The porous matrix 520 may be formed using a plastic sintering process (as described in connection with FIGS. 4A-B) or using an alternate process. Depending on the formation process of the porous matrix 520, the tobacco 130 may be integrally molded with the porous matrix 520 or may be pressure injected into the porous matrix 520 so that the tobacco 130 is disposed in the pores 522.

Optionally, the tobacco article 500 may include a second porous matrix 550 that, in some circumstances, can serve as a saliva reservoir. The saliva reservoir 550 may be a porous matrix that is integrally formed with the first porous matrix 520 that contains the tobacco 130. The saliva reservoir 550 may include pores 552 having a substantially greater pore size and pore volume than the first porous matrix 520. For example, the saliva reservoir may be formed from polymer granules having a much larger size than the granules used to form the first porous matrix 520. Thus, during a plastic sintering process, the saliva reservoir 550 may become a porous matrix having pores 552 that are greater in size than the pores 522 of the first porous matrix 520.

As shown in FIG. 13, the tobacco article 500 may be wholly received by the consumer. For example, the tobacco article 500 may be placed between the gums and the lip of the consumer. In such circumstances, the tobacco article 500 may be exposed to the consumer's saliva.

Referring to FIG. 14, when the first porous matrix 520 is be exposed to the consumer's saliva 540, a portion of the consumer's saliva 540 will be forced into the pores 522. The saliva 540 may pass through the network of pores 522 so that tobacco constituents 132 (and, in some cases, fine tobacco particles) are introduced into the consumer's saliva. Accordingly, the tobacco constituents 132 may mix with the saliva 540 and subsequently be ingested by the consumer. While the tobacco, tobacco constituents, or both tobacco and tobacco constituents are provided to the consumer, the saliva reservoir 550 may absorb some portion of the saliva of the consumer, which may reduce the amount of spitting normally associated with chewing tobacco or snuff. As previously described, the tobacco 130 may be supplemented with extract of tobacco that provides additional tobacco constituents to the tobacco 130 in the first porous matrix 520, thereby increasing the level of tobacco constituents 132 that may be introduced in the saliva 540 for providing to the consumer. Accordingly, the tobacco article 500 may provide tobacco satisfaction to the consumer without combusting the tobacco article 500 or the tobacco 130 disposed therein. Optionally, the tobacco 130 may include one or more flavor agents or other components (as previously described), or flavor agent particles may be disposed in the pores 522 of the porous matrix 520. In such circumstances, the flavor agents may be introduced into the liquid saliva so that a combination of flavor agents and tobacco constituents 132 are provided to the consumer.

When the tobacco 130 in the porous reservoir 550 is exhausted or the consumer decides to remove the tobacco article 500, the tobacco article may be discarded. Thus, the tobacco article 500 may be discretely discarded with some portion of the consumer's saliva retained in the saliva reservoir 550.

A number of embodiments of the invention have been described. Nevertheless, it will be understood that various modifications may be made without departing from the spirit and scope of the invention. Accordingly, other embodiments are within the scope of the following claims.

What is claimed is:

1. A tobacco article, comprising:

a conduit body including a porous matrix and an outer shell surface, the outer shell surface at least partially surrounding the porous matrix, wherein the porous matrix is a unitary structure with the outer shell surface, wherein the porous matrix is integrally formed with the outer shell surface, wherein the porous matrix and the outer shell surface are integrally formed by a plastic sintering process where granules of polymer that form the porous matrix are arranged in a central portion of an internal cavity of a sintering mold and granules of polymer that form the outer shell surface are arranged along an outer portion of the internal cavity of the sintering mold;

tobacco disposed in pores of the porous matrix so that, when at least a portion of the porous matrix is exposed to a liquid, at least one of tobacco or a tobacco constituent is introduced into the liquid.

2. The tobacco article of claim 1, wherein the porous matrix and the outer shell surface each comprise the same material.

3. The article of claim 1, wherein the outer shell surface is a generally continuous layer of material that is substantially impermeable to migration of nicotine.

4. The article of claim 1, wherein the outer shell surface has a substantially cylindrical configuration.

5. The article of claim 1, wherein at least one of the porous matrix or the outer shell surface comprises a copolymer of acrylonitrile and methyl acrylate.

6. The article of claim 1, wherein at least a portion of the porous matrix is wetted through capillary action of the liquid in the pores when the at least a portion of the porous matrix is exposed to the liquid.

7. The article of claim 1, wherein the tobacco constituent comprises an alkaloid that is introduced into the liquid and deliverable to a mouth of a user when the porous matrix is exposed to the liquid.

8. The article of claim 1, wherein the tobacco includes tobacco extract.

9. The article of claim 8, wherein at least a portion of the tobacco extract is substantially disposed on an outer surface of the tobacco.

10. The article of claim 8, wherein the tobacco includes one or more flavor components.

11. The article of claim 1, wherein the tobacco includes portions of at least one of leaves or stems of any member of the genus *Nicotiana*.

12. The article of claim 11, wherein the tobacco comprises at least one of shredded tobacco, cut tobacco, granulated tobacco, or powdered tobacco.

13. The article of claim 1, wherein the outer shell surface fully surrounds the porous matrix and the tobacco disposed therein.

14. The article of claim 1, further comprising a liquid within the porous matrix.

15. A tobacco article, comprising:

a conduit body adapted to provide tobacco to a consumer in the form of a liquid, the conduit body including a porous matrix and an outer shell for guiding water through the porous matrix of the conduit body, the outer shell having a substantially cylindrical configuration surrounding the porous matrix, the outer shell comprising a material that prevents the migration of water from the outer radial area of the porous matrix through the outer shell, the porous matrix comprising pores sized to allow water to progress into the porous matrix through capillary action, wherein the porous matrix and the outer shell are a unitary structure, wherein the porous matrix and the outer shell surface are integrally formed by a plastic sintering process where granules of polymer that form the porous matrix are arranged in a central portion of an internal cavity of a sintering mold and granules of polymer that form the outer shell surface are arranged along an outer portion of the internal cavity of the sintering mold; and tobacco disposed in the pores of the porous matrix so that, when at least a portion of the porous matrix is exposed to water, at least one of tobacco or a tobacco constituent is introduced into the water.

* * * * *